US006480155B1

(12) United States Patent
Eggleston

(10) Patent No.: US 6,480,155 B1
(45) Date of Patent: Nov. 12, 2002

(54) ANTENNA ASSEMBLY, AND ASSOCIATED METHOD, HAVING AN ACTIVE ANTENNA ELEMENT AND COUNTER ANTENNA ELEMENT

(75) Inventor: Steve Eggleston, San Diego, CA (US)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/473,084

(22) Filed: Dec. 28, 1999

(51) Int. Cl.[7] ..... H01Q 1/38
(52) U.S. Cl. ..... 343/700 MS; 343/702
(58) Field of Search ..... 343/700 MS, 702; 455/90, 833, 834

(56) References Cited

U.S. PATENT DOCUMENTS

| | | | | |
|---|---|---|---|---|
| 5,365,246 A | * | 11/1994 | Rasinger et al. | 343/702 |
| 5,550,554 A | | 8/1996 | Erkocevic | 343/828 |
| 5,585,807 A | | 12/1996 | Takei | 343/702 |
| 5,966,094 A | | 10/1999 | Fukasawa et al. | 343/700 |
| 5,966,097 A | * | 10/1999 | Fukasawa et al. | 343/700 MS |

FOREIGN PATENT DOCUMENTS

| | | |
|---|---|---|
| EP | 0 942 488 A2 | 9/1999 |

* cited by examiner

*Primary Examiner*—Don Wong
*Assistant Examiner*—James Clinger
(74) *Attorney, Agent, or Firm*—Milan I. Patel

(57) ABSTRACT

An antenna assembly, and an associated method, for a radio device, such as a mobile terminal operable in a cellular communication system. The antenna assembly includes an active antenna element and at least a parasitic element. The active antenna element is of a selected lengthwise dimension and is resonant, in isolation, at a first resonant frequency. The parasitic antenna element is positioned proximate to the active antenna element and separated therefrom by a selected separation distance. The selected separation distance is determinative of a reduction in frequency at which the active antenna element is resonant. Thereby, for a given length, the resonant frequency of the active antenna element is reduced, permitting the lengthwise dimensional requirements of the antenna transducer of which the active antenna element is formed to be reduced relative to conventional antenna transducers.

20 Claims, 4 Drawing Sheets

ANTENNA ASSEMBLY, AND ASSOCIATED METHOD, HAVING AN ACTIVE ANTENNA ELEMENT AND COUNTER ANTENNA ELEMENT

The present invention relates generally to antenna apparatus used to transduce radio frequency signals, such as the radio frequency signals generated by, or received at, a mobile terminal operable in a cellular, or other radio, communication system. More particularly, the present invention relates to an antenna assembly, and an associated method, which utilizes a counter antenna element together with an active antenna element. The counter antenna element operates to reduce the frequency about which the active antenna element is resonant without necessitating a corresponding increase in the length of the active antenna element. The antenna assembly is thereby able to be of reduced lengthwise dimensions relative to conventional antennas operable about a resonant frequency.

BACKGROUND OF THE INVENTION

A communication system permits the communication of information between a sending station and a receiving station by way of a communication channel. The sending station is operable to generate a communication signal of characteristics permitting its communication upon the communication channel. And, the receiving station is operable to recover the informational content of the communication signal.

A radio communication system is a communication system in which the communication channel upon which the communication signal is communicated is formed of a radio channel. The radio channel is defined upon a portion of the electromagnetic spectrum. Because a wireline connection is not required to form the communication channel between the sending and receiving stations, communications are possible when such a wireline connection between the sending and receiving stations would be impractical. Improved communication mobility is also possible through use of a radio communication system.

A sending station forming a portion of a radio communication system includes a transmitter for modulating information upon a carrier wave of a carrier frequency within the range of frequencies which defines, at least in part, the communication channel. Through such a process, a baseband signal of which the information is formed is converted into a radio frequency signal of desired frequency characteristics.

The transmitter typically includes one or more up-mixing stages at which the baseband information is up-converted in frequency to be of the selected radio frequency. The mixing stages include mixer circuits coupled to receive the information and an up-mixing signal with which the information is to be multiplied, or otherwise combined, to form an up-converted signal. When multiple mixing stages are utilized, an if (intermediate frequency) signal is formed at a first, or first series of, mixer stages. A radio frequency signal is formed at the final mixing stage.

A receiving station operable to receive a radio-frequency communication signal transmitted thereto upon a radio communication channel, analogously, converts the radio frequency signal to a baseband level. One or more down-conversion stages down-converts the radio frequency signal to a baseband level.

A cellular communication system is exemplary of a radio communication system. Cellular communication systems, constructed according to various cellular communication standards, have been installed throughout significant portions of the world. A subscriber to a cellular communication system is able to communicate therein by way of a mobile terminal when the mobile terminal is positioned within an area encompassed by the communication system. Telephonic communication of both voice and nonvoice information is permitted by way of such communication systems. The mobile terminal is formed of transceiver circuitry and includes both a sending station and a receiving station.

A mobile terminal operable in a cellular communication system, or other communication system providing for two-way communications, includes both a transmitter and a receiver to permit the sending of, and reception of, communication signals thereat.

Both the transmitter and the receiver are connected, typically, to an antenna transducer. The antenna transducer transduces radio frequency, electrical signals generated by the transmitter into electromagnetic form for communication upon the communication channel. And, the antenna transducer transduces electromagnetic signals communicated upon the communication channel and received at the receiver, into electrical form to permit receiver operation to be performed upon the resultant, electrical signal. A single antenna transducer is typically utilized for both the transmitter and receiver of a mobile terminal, or other two-way communication device, through utilization of a filter duplexer when communications are effectuated pursuant to a frequency division multiplexing scheme having separate transmit and receive passbands.

Advancements in integrated circuit, and other, technologies have permitted reduction in the physical dimensions of electronic circuits, such as the circuits of which the receiver and transmitter of a mobile terminal are formed. Many mobile terminals operable in cellular communication systems, for instance, are contained in housings which permit the mobile terminals, so-formed, to be carried by a user and stored, for instance, when not in use, in a shirt pocket, or the like, of the user.

Antenna transducers, forming essential portions of most mobile terminals, however, have generally not exhibited a corresponding decrease in their physical dimensions. Such antenna transducers are, conventionally, of lengths related to the wavelengths of the signals to be transduced by the antenna transducer. As a result, while other portions of the mobile terminal are of increasingly smaller dimensions, the antenna transducers of the mobile terminals form increasingly large proportions of the resultant packages of which the mobile terminals are formed.

If a manner could be provided by which to reduce the lengthwise dimension of the antenna transducer while still ensuring operation of the antenna transducer to transduce signals of a selected range of wave lengths, a radio circuit including such an antenna transducer could be of reduced physical dimensions.

It is in light of this background information related to antenna apparatus that the significant improvements of the present invention have evolved.

SUMMARY OF THE INVENTION

The present invention, accordingly, advantageously provides antenna apparatus, and an associated method, in which a counter antenna element is positioned at a selected distance from an active antenna element. The counter antenna element operates to permit the frequency about which the active antenna element is resonant to be reduced without necessitating an increase in the length of the active antenna element. The separation distance separating the counter antenna element and the active antenna element is determinative of the reduction in the resonant frequency about which the active antenna element is operable to transduce send and receive signals. By reducing the frequency about which the antenna transducer is resonant without requiring alteration of the lengthwise dimension of the active antenna element, increased miniaturization of the communication device of which the antenna element forms a portion is possible.

In one aspect of the present invention, an antenna assembly is provided for a mobile terminal operable in a cellular, or other radio, communication system. The antenna assembly includes an active antenna element positioned to extend in a forward direction and an antenna counter element positioned proximate thereto and extending in a reverse direction. The antenna counter element is spaced apart from the active antenna element by a selected distance. The selected distance by which the antenna counter element is spaced apart from the active antenna element is determinative of the alteration in frequency about which the active antenna element is resonant. By causing appropriate reduction in the frequency at which the active antenna element is resonant, a reduction in the lengthwise dimension of an active antenna element, operable over a selected range of frequencies, relative to conventional antenna elements, is possible.

In such an implementation, the mobile terminal is provided with an antenna assembly capable of transducing communication signals, either transmit signals or receive signals, about a resonant frequency at which the active antenna element of the assembly is resonant.

In one implementation, the active antenna element is mounted upon a substrate at which at least portions of the radio circuitry of the mobile terminal are disposed. The active antenna element is positioned to extend in a forward direction, i.e., a dorsal side portion of the active antenna element is connected to a ground part of the radio circuitry of the mobile terminal. And, the active antenna element is also connected to an rf (radio frequency) part of the radio circuitry of the mobile terminal. The antenna counter element is also mounted upon the substrate and is positioned to extend in a reverse direction, i.e., the antenna counter element is connected at a distal side portion thereof to the ground part of the radio circuitry of the mobile terminal. In isolation, the active antenna exhibits resonance about a first resonant frequency. Positioning of the antenna counter element at a selected distance therefrom offsets the resonant frequency at which the active antenna element is resonant to a forward, offset resonant frequency. Because of the inverse relationship between frequency and wavelength, and because the active antenna element is of a lengthwise dimension dependent upon the wavelength of signals to be transduced thereat, an offset of the frequency at which the active antenna element is resonant, caused by the antenna counter element, permits an active antenna element of reduced lengthwise dimensions, relative to conventional active elements, to be utilized at the mobile terminal. In an implementation in which the mobile terminal forms a dual-mode device, separate active antenna elements, each of reduced lengthwise dimensions relative to their conventional counterparts, are employed at the mobile terminal.

In a further implementation, the antenna assembly includes an active antenna element positioned to extend in the forward direction, i.e., the active antenna element is connected at a dorsal side portion thereof to the ground part of the radio circuitry of the mobile terminal. The active antenna element is further coupled to the rf part of the radio circuitry. An antenna counter element is positioned proximate to the active antenna element, at a selected spaced distance therefrom, and positioned to extend in a reverse direction, i.e., the antenna counter element is connected at a distal side portion thereof to the ground part of the radio circuitry. A third antenna element is also utilized, spaced-apart from the antenna counter element, and positioned to extend in a forward direction, i.e., the third antenna element is connected at a dorsal side portion thereof to the ground part of the radio circuitry. The third antenna element is operable to alter the frequency characteristics of the resultant antenna assembly. By positioning the third antenna element in proximity to the antenna counter element and, in turn, the active antenna element, the resultant antenna assembly is resonant about a single resonant frequency rather than at two or more separate resonances.

In another implementation, the active antenna element and the antenna counter element are positioned in tandem and maintained in a spaced-apart relationship by the selected separation distance. The resultant antenna assembly is translatably coupled to a substrate to permit translation of the active antenna element together with the antenna counter element, thereby to be positionable at least alternately in an "up" position and in a "down" position.

In these and other aspects, therefore, an antenna assembly, and an associated method, is provided for radio circuitry operable to communicate radio signals. The radio circuitry includes a ground part and an rf (radio frequency) part. A first antenna element has a dorsal side portion and a distal side portion. The first antenna element is connected at a ground-part-connection location of the dorsal side portion thereof to the ground part of the radio circuitry. The first antenna element is connected to the rf part of the radio circuitry at an rf-part-connection location. The rf-part-connection location is spaced apart from the ground-part-connection location. The first antenna element, in isolation, is resonant about a first resonant frequency. A second antenna element also has a dorsal side portion and a distal side portion. The second antenna element is spaced apart from the first antenna element by a first selected distance. The second antenna element is connected at a ground-part-connection location of the distal side portion thereof to the ground part of the radio circuitry. Positioning of the second antenna element at the selected distance from the first antenna element offsets the first resonant frequency at which the first antenna element is, in isolation, resonant, thereby to be resonant at a first offset frequency.

A more complete appreciation of the present invention and the scope thereof can be obtained from the accompanying drawings, which are briefly summarized below, the following detail description of the presently-preferred embodiments of the present invention, and the appended claims.

DETAILED DESCRIPTION OF THE PREFERRED EMBODIMENT

Figure 1:
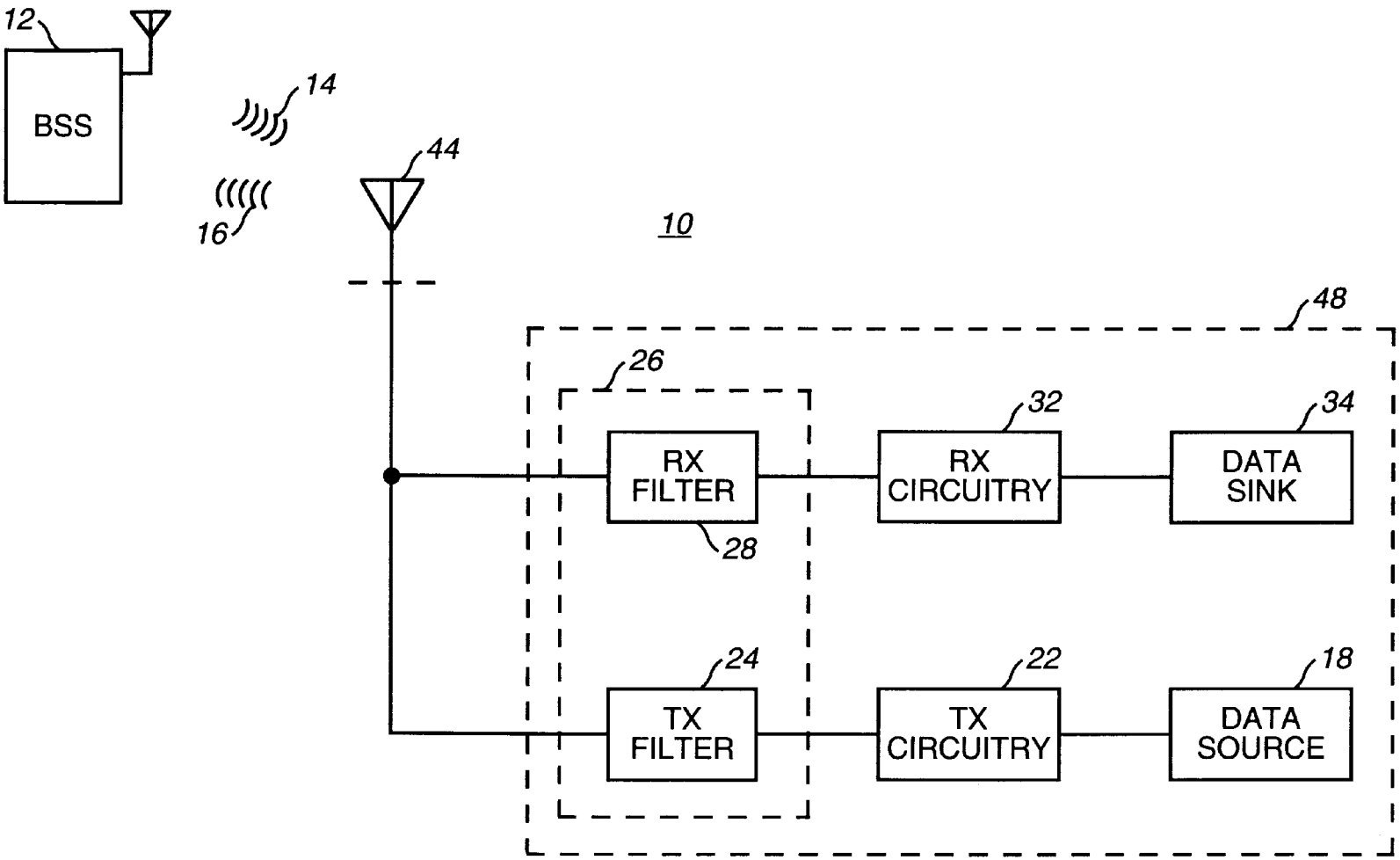
FIG. 1 illustrates a functional block diagram of a mobile terminal operable in a radio communication system and which includes an embodiment of the present invention.

Referring first to FIG. 1, a mobile terminal, shown generally at 10, is operable in a radio communication system to transceive communication signals with a remote communication station, here represented by a base station system (BSS) 12 of a public land mobile network (PLMN). Forward link signals 14 generated by the base station system on forward link channels are transmitted to the mobile terminal 10, and reverse-link signals 16 generated by the mobile terminal are sent upon reverse-link channels to the base station system.

The mobile terminal 10 includes a transmit portion, here shown to include a data source 18 at which information to be communicated by the mobile terminal is generated, or from which such information is retrieved. The data source is coupled to transmit circuitry 22 which is operable to generate communication signals which form the reverse-link signal 16. The transmit circuitry performs functions such as modulation and up-conversion operations. The transmit portion also includes a transmit filter 24 which, here, forms a portion of a filter duplexer 26.

The mobile terminal 10 also includes a receive portion, here including a receive filter 28 which forms a portion of the filter duplexer 26. The receive filter is coupled to receive circuitry 32. The receive circuitry performs functions such as down-conversion and demodulation operations. And, the receive circuitry, in turn, is coupled to a data sink 34.

Both the transmit portion and the receive portion of the mobile terminal are coupled to an antenna assembly 44 of an embodiment of the present invention. The antenna assembly is operable to transduce communication signals, in electrical form, provided by the transmit portion of the mobile terminal into electromagnetic form to form the reverse-link signal 16 transmitted on the reverse-link channels. The antenna assembly is further operable to transduce, into electrical form, the forward-link signals 14 detected by the transducer.

Generally, an antenna transducer includes a portion, formed of a metallic, or other conductive, material of a length proportional to the wavelengths of the forward- and reverse-link signals 14 and 16 transduced thereat. For instance, the length is sometimes selected to correspond to one-quarter of the length of the wavelength of the signals to be transduced. The frequency of a signal and the wavelength of the signal are inversely related. That is to say, as the frequency of the signal increases, the wavelength of the signal decreases and, the corresponding length of the antenna transducer correspondingly decreases. Conversely, as the frequency of a signal to be transduced by the antenna transducer is decreased, the wavelength of the signal, and the corresponding length of the antenna transducer increases.

Various of the existing, and proposed, cellular communication systems are, or are to be, operable at relatively high frequencies, such as at the 850 MHz range. An antenna transducer constructed to form a portion of a mobile terminal operable at such a frequency range of a one quarter wavelength configuration is conventionally of almost nine centimeters in length. As the circuitry of the mobile terminal is increasingly able to be miniaturized, the antenna transducer of an antenna assembly, which conventionally is not reduced in dimension, increasingly is a limiting factor in additional miniaturization of the mobile terminal. The antenna assembly of an embodiment of the present invention is of reduced lengthwise dimensions relative to corresponding, conventional antenna transducers, thereby facilitating additional miniaturization of a mobile terminal.

Figure 2:
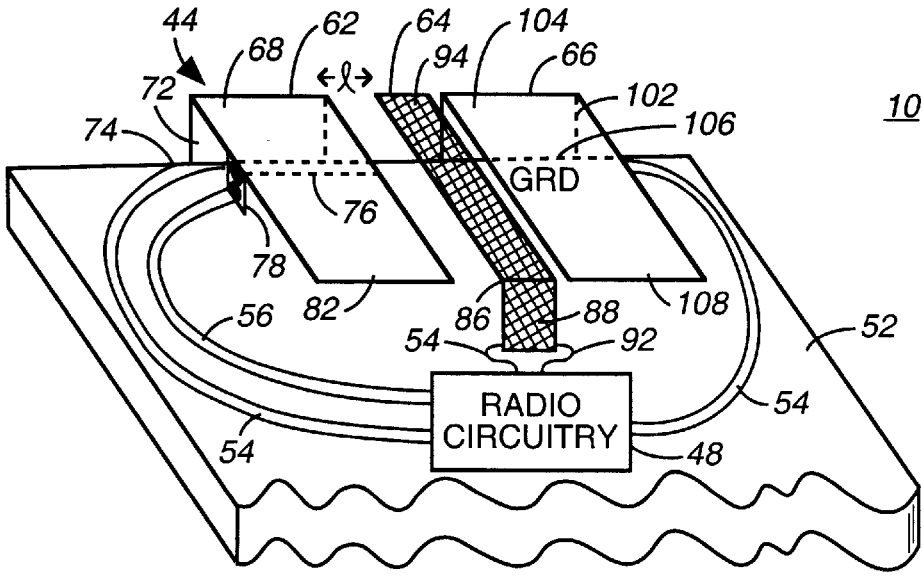
FIG. 2 illustrates a partial functional block, partial functional view of an antenna assembly of an embodiment of the present invention.

FIG. 2 illustrates a portion of the mobile terminal 10 shown in FIG. 1, including the antenna assembly 44 of the mobile terminal. Here, the radio circuitry 48 is formed upon a printed circuit board 52. The radio circuitry includes an rf (radio frequency) part, i.e., a portion of a circuitry biased at a voltage level, and a ground part, i.e., a portion of the circuitry at a ground potential. Ground paths 54 are formed upon a surface of the circuit board. And, an rf path 56 is also formed upon the surface of the circuit board. The ground paths forms portions of the ground part of the radio circuitry, and the rf path 56 forms a portion of the rf part of the radio circuitry.

The antenna assembly 44 here includes a first antenna element 62, a second antenna element 64, and a third antenna element 66. The antenna elements 62, 64, and 66 are supported upon the surface of the circuit board 52 and are positioned to extend in substantially-corresponding, longitudinally-extending directions. Each of the antenna elements 62, 64, and 66 are formed of metallic materials, such as metallic strips.

The first antenna element 62 includes a dorsal side portion 68 including a back-angled end portion 72 having an edge portion forming a ground-connection-location 74. The ground-connection-location 74 is electrically connected, such as by a solder connection, to a ground path 54. The first antenna element 62 defines a central body portion which extends to a distal side portion 82 of the antenna element. An rf-connection-location 76 at which the antenna element 62 is electrically connected to a radio path 56, here by way of a mounting element 78 protruding above the surface of the printed circuit board, to electrically connect the antenna element to the radio part of the radio circuitry. A side portion of the antenna element 62 opposite that of the dorsal side portion 68 defines a distal side portion 82 of the antenna element. Because of the electrical connection of the antenna element to both the ground part and the radio part of the radio circuitry, the antenna element 62 forms an active antenna element. In the exemplary implementation, the antenna element forms a PIFA (planar inverted F antenna) element.

The second antenna element 64 extends in a reverse direction to that of the forward-direction extending first to antenna element 62. The second element 64 defines a distal side portion 86 having a back-angled portion 88. The bottom edge of the distal side portion 86 defines a ground-connection-location 92 which is electrically connected to a ground path 54, such as by a solder connection. The second antenna element includes a central body portion which extends to, and includes, a dorsal side portion 94 of the antenna element. Because the second antenna element is connected only to a ground part of the radio circuitry, the antenna element forms a parasitic element.

The third antenna element 66 also includes a dorsal side portion 102 having a back-angled part 104. An edge of the back-angled portion defines a ground-connection-location 106 which is electrically connected to a ground path 54, affixed such as by way of a solder connection. The third antenna element also includes a central body portion which extends to, and includes, a distal side portion 108. The third antenna element 66, analogous to the first antenna element 62, extends in a forward direction and also forms a PIFA (planar inverted F antenna).

The active antenna element of which the first antenna element 62 is formed is of a selected length L. While conventional antenna transducers are of length corresponding to a fraction, e.g., a quarter, of a wavelength of the wavelength of signals to be transduced thereat, utilization of the second antenna element in the manner indicated in the figure permits the antenna element to be of a reduced lengthwise dimension L-x, relative to the length conventionally required. That is to say, the second antenna element 64 is positioned at a selected distance, l, from the first antenna element 62. The reduction in frequency about which the first antenna element is resonant, and a corresponding reduction in the required length of the antenna element is inversely proportional to the separation distance l. Thereby, for a given frequency of signals which are to be transduced by the antenna element 62, utilization of the parasitic antenna element of which the second antenna element 64 is formed, permits the antenna element to be operable at a lower frequency without altering the required lengthwise dimension of the antenna element. The third antenna element 66 is operable to merge together resonances at which the antenna assembly 10 is resonant. By appropriate selection of the separation distance at which the antenna element 66 is separated from the antenna element 62, a signal resonance, frequency characteristic of the antenna assembly is formed.

Figure 3:
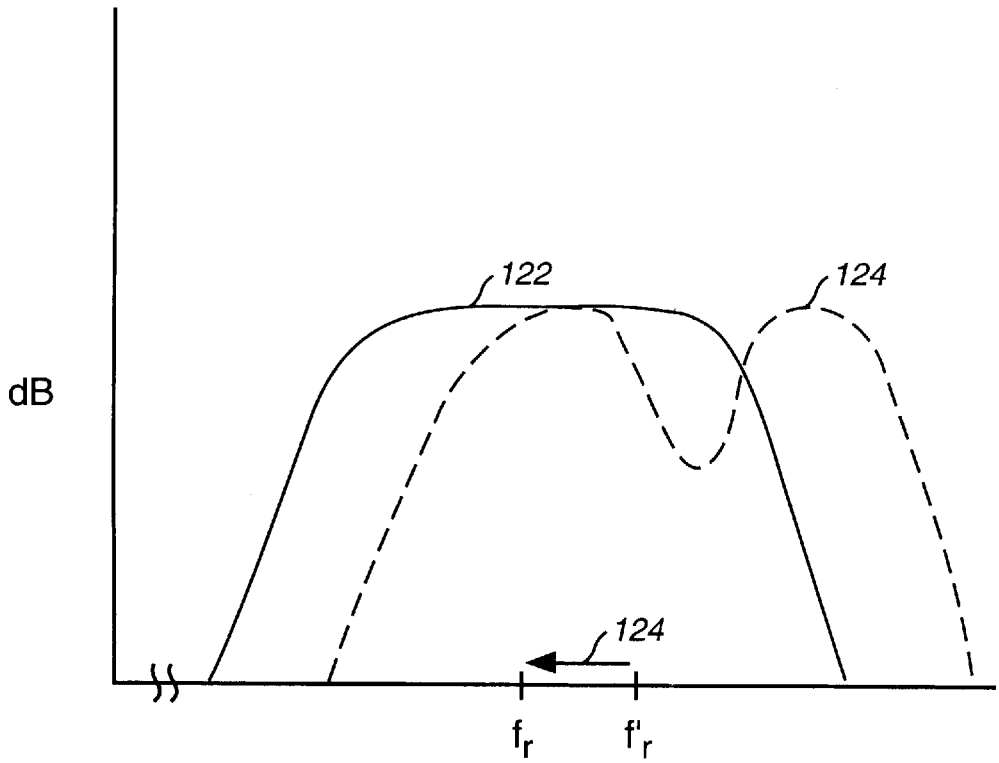
FIG. 3 illustrates a graphical representation of the frequency characteristics of the antenna assembly shown in FIG. 2.

FIG. 3 illustrates a graphical representation, shown generally at 122, of the frequencies of resonance of the antenna element 62 of the antenna assembly. As illustrated, the antenna is resonant about a resonant frequency $f_r$. That is to say, the antenna is operable to transduce signals within the range of resonance frequencies about the resonant frequency. The utilization of the parasitic antenna element 64 lowers, for a given lengthwise dimension of the active antenna element, the resonant frequency, in the manner indicated by the arrow 124 offsetting the initial resonant frequency $f'_r$ to the as-shown resonant frequency $f_r$. And, utilization of the third antenna element 66 pulls the resonant frequencies of the antenna elements together from the curve 124, shown in dash. Thereby, through utilization of an antenna assembly 44 of an embodiment of the present invention, for a given lengthwise dimension of an active antenna element, the frequency range of operation of the antenna element is reduced. Increased miniaturization of a mobile terminal, or other radio device, including such an antenna assembly, is permitted.

Figure 4:
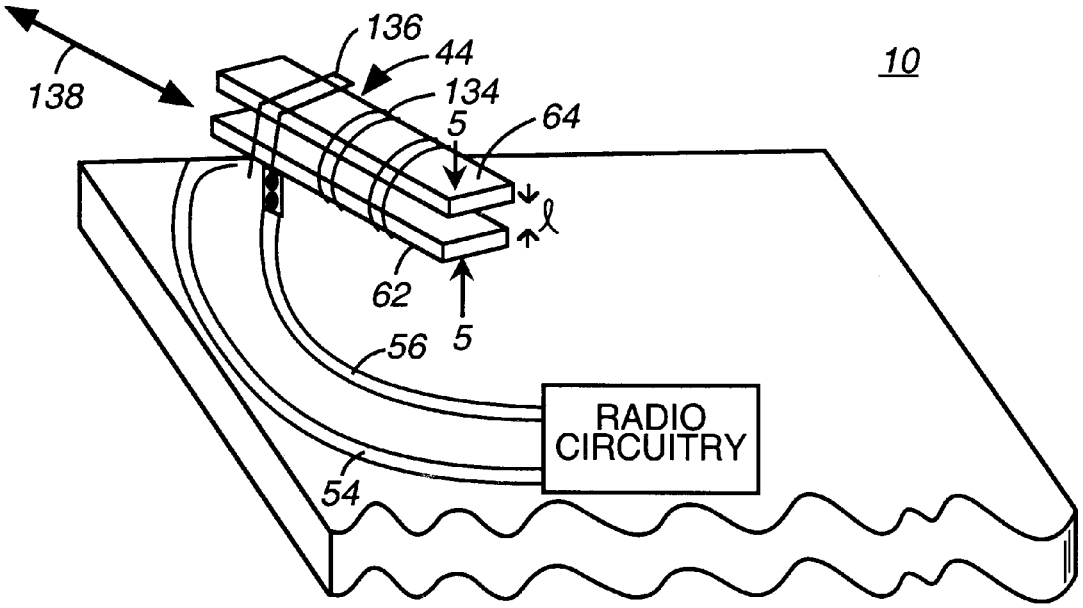
FIG. 4 illustrates a partial functional block, partial perspective view of an antenna assembly of another embodiment of the present invention.
Figure 5A:
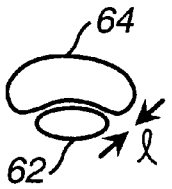
FIG. 5A illustrates a cross-sectional view of the antenna assembly shown in FIG. 4.
Figure 5B:
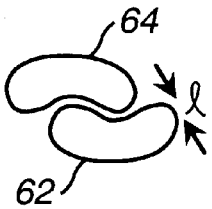
FIG. 5B illustrates a cross-sectional view, similar to that shown in FIG. 5, but of an antenna assembly of another embodiment of the present invention.

FIG. 4 illustrates portions of the mobile terminal 10 which includes an antenna assembly 44 of another embodiment of the present invention as a portion thereof. Analogous to the embodiment shown in FIG. 2, the antenna assembly 44 includes a first antenna element 62 and a second antenna element 64. While a third antenna element is not shown in the Figure, such an antenna element can also form a portion of the antenna assembly 44 shown in the Figure. In this implementation, the antenna elements 62 and 64 are tandemly-positioned, and separated by the separation distance l in a vertical dimension. Appropriate support structure, such as a thermoplastic, supportive enclosure of which a portion 134 thereof is shown in the Figure, maintains the selected separation distance l between the antenna elements. The elements 62 and 64 are translatably coupled to the circuit board 52, here by way of a mount 136, to permit translation of the antenna assembly back and forth in the direction indicated by the arrow 138. Thereby, the antenna assembly is selectably positionable in either an up position or a down position. The antenna assembly is otherwise operable in a manner as described above with respect to FIGS. 2 and FIGS. 5A and 5B illustrate cross-sectional views of the antenna assembly taken through the line 5—5 of FIG. 4 according to two separate implementations. In each implementation, the antenna assembly is shown to be formed of the first antenna element 62 and second antenna element 64 separated by a separation distance l.

Figure 6:
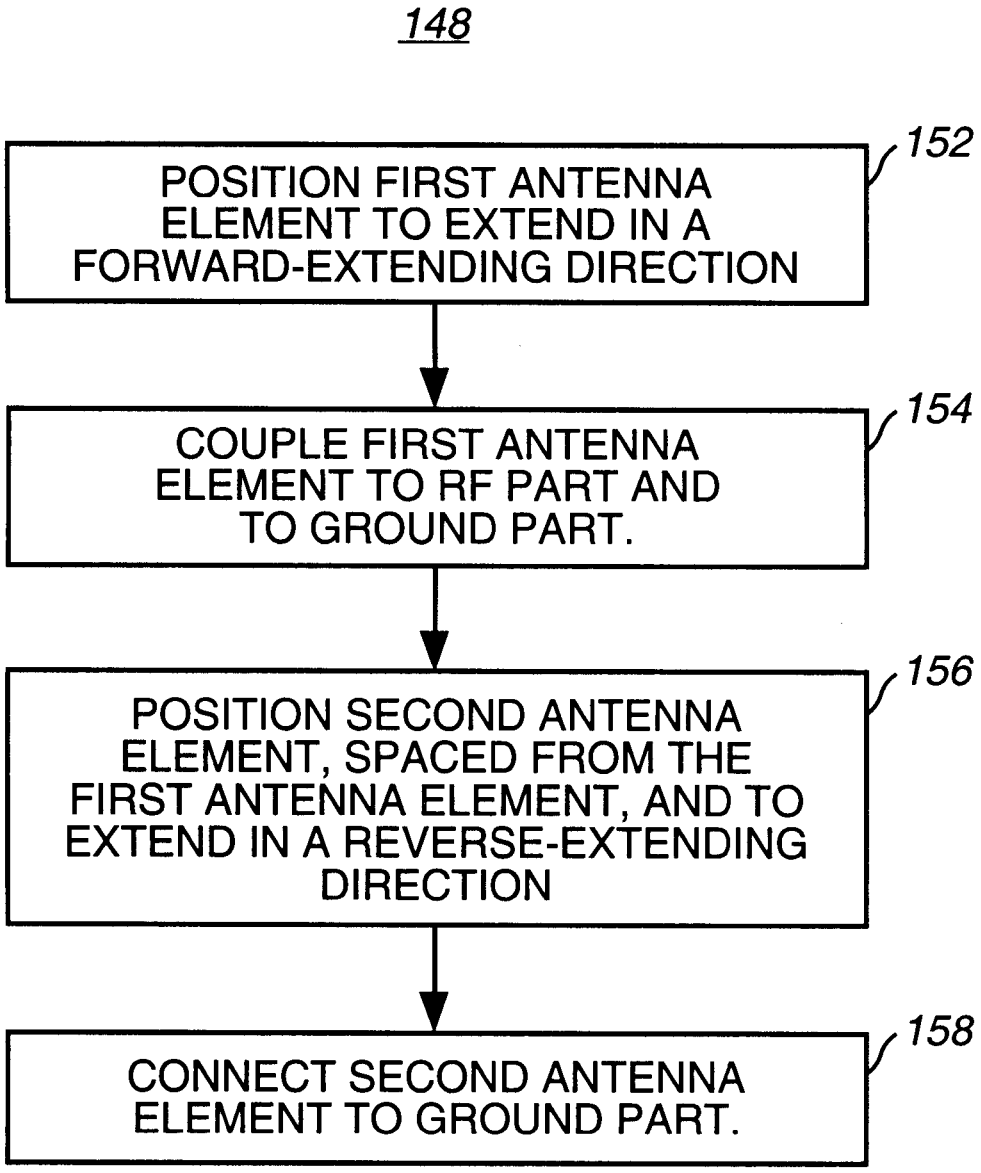
FIG. 6 illustrates a method flow diagram listing the steps of the method of an embodiment of the present invention.

FIG. 6 illustrates a method flow diagram, shown generally at 148, showing the method steps of the method of operation of an embodiment of the present invention. The method is operable to transduce radio signals.

First, and as indicated by the block 152, a first antenna element is positioned in a forward-extending direction. Then, and as indicated by the block 154, the first antenna element is coupled to the ground part and to the rf part of radio circuitry, thereby to cause the first antenna element, in isolation, to be resonant about a first resonant frequency.

Then, and as indicated by the block 156, a second antenna element is positioned in a reverse-extending direction, spaced apart from the first antenna element by a first selected distance. Thereafter, and as indicated by the block 158, the second antenna element is connected to the ground part of the radio circuitry, thereby offsetting the first resonant frequency at which the first antenna element, in isolation, is resonant, thereafter to be resonant at a first offset frequency.

The previous descriptions are of preferred examples for implementing the invention, and the scope of the invention should not necessarily be limited by this description. The scope of the present invention is defined by the following claims.

I claim:

1. An antenna assembly for radio circuitry operable to communicate radio signals at least within a selected frequency range and having a ground part and a rf (radio frequency) part, said antenna assembly comprising:

a first antenna element of a first lengthwise dimension, L-x, and having a dorsal side portion and a distal side portion, said first antenna element connected at a ground-part-connection location of the dorsal side portion thereof to the ground part of the radio circuitry and connected to the rf part of the radio circuitry at a rf-part-connection location, the rf-part-connection location spaced apart from the ground-part-connection location, said first antenna element, in isolation, resonant about a first resonant frequency, the first resonant frequency about which, in isolation, said first antenna element is resonant being related to an antenna transducer of length L-x; and a second antenna element also having a dorsal side portion and a distal side portion, said second antenna element spaced apart from said first antenna element by a first selected distance, l, and connected at a ground-part-connection location of the distal side portion thereof to the ground part of the radio circuitry, positioning of said second antenna element at the selected distance from said first antenna element offsetting the first resonant frequency at which said first antenna element is, in isolation, resonant, thereby to be resonant at a first offset frequency, the first offset frequency about which said first antenna element is resonant being related to an antenna transducer, in isolation, of length L, the first offset frequency within the selected frequency range.

2. The antenna assembly of claim 1 wherein the radio circuitry is disposed at a substrate and wherein said first antenna element and said second antenna element are attached to the substrate.

3. The antenna assembly of claim 2 wherein said first antenna element and said second antenna element are translatably attached to the substrate, together translatable between a first translation position and a second translation position.

4. The antenna assembly of claim 1 wherein said first antenna element comprises a body portion extending in a first longitudinal direction and wherein said second antenna element also comprises a body portion, the body portion of said second antenna element extending substantially in the first longitudinal direction.

5. The antenna assembly of claim 1 wherein the dorsal side portion of said first antenna element comprises a back-angled end portion, the ground-part-connection location of said first antenna element positioned at the back-angled end portion thereof.

6. The antenna assembly of claim 5 wherein the distal side portion of said second antenna element comprises a back-angled end portion, the ground-part-connection location of said second antenna element positioned at the back-angled end portion thereof.

7. The antenna assembly of claim 6 wherein portions of said first antenna element extending beyond the bank-angled end portions of the dorsal side portions thereof extends in a first longitudinal direction.

8. The antenna assembly of claim 7 wherein portions of said second antenna element extending beyond the back-angled end portion of the distal side portion thereof extend in a second longitudinal direction, the second longitudinal direction substantially corresponding to the first longitudinal direction.

9. The antenna assembly of claim 8 wherein portions of said first antenna element extending beyond the back-angled end portion of the dorsal side portion thereof are of a first lengthwise dimension and wherein portions of said second antenna element extending beyond the back-angled end portion of the distal side portion thereof are of a second lengthwise dimension, the first and second lengthwise dimensions, respectively, of substantially similar lengths.

10. The antenna assembly of claim 1 further comprising a third antenna element also having a dorsal side portion and a distal side portion, said third antenna element connected at a ground-part-connection location of the dorsal side portion thereof to the ground part of the radio circuitry, said third antenna element forming a parasitic element spaced apart from said first antenna element by a second selected distance, the second selected distance at which said third antenna element is spaced from said first antenna element in part determinative of an antenna-assembly frequency response.

11. The antenna assembly of claim 10 wherein the second selected distance is greater than a sum of a widthwise dimension of said second antenna element and the first selected distance and wherein said second antenna element is positioned between said first antenna element and said third antenna element, respectively.

12. The antenna assembly of claim 10 wherein said first antenna element comprises a body portion extending in a first longitudinal direction and wherein said third antenna element also comprises a body portion, the body portion of said third antenna element extending substantially in the first longitudinal direction.

13. The antenna assembly of claim 1 wherein the dorsal side portion of said first antenna element comprises a back-angled end portion, the ground-part-connection location of said first antenna element positioned at the back-angled end portion thereof.

14. The antenna assembly of claim 13 wherein said third antenna element comprises a Planar Inverted F Antenna.

15. The antenna assembly of claim 1 wherein said first antenna element comprises a Planar Inverted F Antenna.

16. In a method for communicating with a radio device having radio circuitry operable to communicate radio signals at least within a selected frequency range, the radio circuitry mounted at a substrate and having a ground part and a rf part, an improvement of a method for transducing the radio signals, said method comprising:

positioning a first antenna element in a forward-extending direction, the first antenna element of a first lengthwise dimension L-x;

connecting the first antenna element to the ground part and to the rf part of the radio circuitry, thereby to cause the first antenna element, in isolation, to be resonant about a first resonant frequency, the first resonant frequency about which, in isolation, the first antenna element is resonant being related to an antenna transducer of length L-x;

positioning a second antenna element in a reverse-extending direction, spaced apart from the first antenna element by a first selected distance, l;

connecting the second antenna element to the ground part of the radio circuitry, thereby offsetting the first resonant frequency at which the first antenna element, in isolation, is resonant, thereafter to be resonant at a first offset frequency, the first offset frequency about which the first antenna element is resonant being related to an antenna transducer, in isolation, of length L, the first offset frequency within the selected frequency range.

17. The method of claim 16 comprising the additional operations of:

positioning a third antenna element in a forward-extending direction, spaced apart from the second antenna element by a second selected distance; and connecting the third antenna element to the ground part of the radio circuitry.

18. The method of claim 16 wherein the first antenna element connected during said operation of connecting the first antenna element is translatably connected to the ground part and the rf part of the radio circuitry and wherein the second antenna element connected during said operation of connecting the second antenna element is translatably connected to the ground part of the radio circuitry, the first antenna element and the second antenna element translatable together in unison.

19. The antenna assembly of claim 18 comprising the additional operations of:

determining, for a lengthwise dimension of the first antenna element, a desired offset by which to offset the first resonant frequency; and selecting the first spaced apart distance at which to position the second antenna element to cause the first resonant frequency to be offset by the desired offset.

20. In a radio device having radio circuitry operable to communicate radio signals, the radio circuitry mounted at a substrate and having a ground part and a rf (radio frequency) part, an improvement of an antenna assembly for transducing the radio signals within a selected frequency range, said antenna assembly comprising:

a first antenna element of a first lengthwise dimension, L-x, said first antenna element extending in a first lengthwise direction and having a dorsal side portion and a distal side portion, said first antenna element connected at the dorsal side portion thereof to the ground part of the radio circuitry, and said first antenna element connected to the rf part of the radio circuitry at a selected distance from the dorsal side portion at which said first antenna element is connected to the ground part, said first antenna element, in isolation, resonant about a first resonant frequency, the first resonant frequency about which, in isolation, said first antenna element is resonant being related to an antenna transducer of length L-x;

a second antenna element of a second selected lengthwise dimension, positioned to have a portion thereof extend in a direction substantially corresponding to the first lengthwise direction in which said first antenna element extends and having a dorsal side portion and a distal side portion, said second antenna element connected at the distal side portion thereof to the ground part of the radio circuitry, said second antenna element spaced apart from said first antenna element by a selected distance, l, thereby to reduce the first resonant frequency at which said first antenna element is resonant, said first antenna element thereby resonant at a reduced, resultant frequency, the reduced, resultant frequency about which said first antenna element is resonant being related to an antenna transducer, in isolation, of length L, the reduced, resultant frequency range.

* * * * *